United States Patent [19]

Franssen, deceased et al.

[11] 4,399,328

[45] Aug. 16, 1983

[54] DIRECTION AND FREQUENCY INDEPENDENT COLUMN OF ELECTRO-ACOUSTIC TRANSDUCERS

[75] Inventors: Nico V. Franssen, deceased, late of Knegsel, Netherlands; by Friedrich J. de Haan, administrator, Dommelen, Netherlands

[73] Assignee: U.S. Philips Corporation, New York, N.Y.

[21] Appl. No.: 237,303

[22] Filed: Feb. 23, 1981

[30] Foreign Application Priority Data

Feb. 25, 1980 [NL] Netherlands ..... 8001119

[51] Int. Cl.[3] ..... H04R 1/40; H04R 5/02; H04R 5/027

[52] U.S. Cl. ..... 179/1 GA; 181/144

[58] Field of Search ..... 179/1 D, 1 E, 1 GA, 179/121 R, 121 D, 139, 146 E; 181/144

[56] References Cited

U.S. PATENT DOCUMENTS 4,199,658 4/1980 Iwahara ..... 179/1 GA
4,233,472 11/1980 Kleis ..... 179/1 GA

FOREIGN PATENT DOCUMENTS 695912 8/1953 United Kingdom ..... 181/144

OTHER PUBLICATIONS

Augspurger, "Column Loudspeaker Systems", Electronics World, Jun. 1963, pp. 25–27.
Ward, "Another Word on Multiple Speakers", Audio, Dec. 1962, pp. 19–22.

*Primary Examiner*—A. D. Pellinen
*Attorney, Agent, or Firm*—Robert T. Mayer; Bernard Franzblau

[57] ABSTRACT

An electro-acoustic arrangement comprising a plurality of transducer units including five, seven or nine equally spaced transducers situated in line with the transducers connected to a transmission channel via individual amplitude control devices. The amplitude control devices are adjusted so that the ratios between the conversion factors of the transducer units viewed from end to end are $1:2n:2n^2:-2n:1$ for five transducers to produce an output signal substantially independent of direction and/or frequency. The invention also relates to a combination of five, seven or nine of the foregoing arrangements situated adjacent each other or in line at equal distances with further amplitude control devices connected to a transmission channel. The amplitude control devices are adjusted so that the ratios between the conversion factors of the arrangements, viewed from end to end, form a special relationship.

20 Claims, 11 Drawing Figures

DIRECTION AND FREQUENCY INDEPENDENT COLUMN OF ELECTRO-ACOUSTIC TRANSDUCERS

The invention relates to an arrangement for receiving or emitting sound waves comprising $(2k+1)$ transducer units with substantially identical directivity patterns (k being an integer and $2 \leqq k \leqq 4$), which transducer units are situated in line at equal distances ($d_1$) from each other, are connected to a common electrical transmission channel and are each provided with an amplitude control device for adjusting the conversion factor of the associated transducer unit, transducer units which are disposed symmetrically relative to the central transducer unit having conversion factors of equal value, the phase shifts in the transducer units being equal, but the phase shift in one of every two of those transducer units which are situated at equal odd multiples of the distance ($d_1$) from the central transducer unit differing by 180° from that in the other, and the conversion factors being selected so that a frequency and direction independent conversion of the sound waves is at least substantially obtained.

The invention also relates to a combination of a plurality of arrangements.

An arrangement of the type mentioned in the preamble is known from Netherlands Pat. No. 112,868.

The known arrangement may comprise a plurality of microphones or loudspeakers disposed at equal distances from each other. However, the invention may also be applied to arrangements in which the microphones or loudspeakers are constituted by electret transducers. The electret transducers may then comprise a single electret transducer, said transducers being obtained by dividing the electret diaphragm into separate equidistantly disposed diaphragm sections.

The ratios between the conversion factors of the transducer units in the known arrangement are adjusted to accord with the coefficients of the Bessel function of the first kind and with an argument corresponding to half the greatest odd number of transducer units in the arrangement minus three. In an arrangement with microphones this enables an electric output signal to be obtained which is substantially independent of the frequency and of the direction of an acoustic signal received by the microphone. In an arrangement with loudspeakers, an electric signal with a flat frequency characteristic is applied to the arrangement so that an acoustic signal, which has been converted by the loudspeakers, is obtained which is substantially independent of the frequency and independent of the direction in which the acoustic signal is radiated.

However, the known arrangement has the drawback that the Bessel coefficients to be used for the ratios between the conversion factors yield inconvenient values, so that the conversion factors can be realized only by means of very intricate analogue or digital circuitry and many passive components, such as resistors.

It is an object of the invention to provide an arrangement which is much easier to realize, while maintaining the advantages of the known arrangement.

The arrangement according to the invention is characterized in that when an index x (x being an integer $\leqq k+1$) is assigned to a plurality of transducer units, the index 1 being assigned to one of the extreme transducer units, consecutive indices to consecutive adjacent transducer units, proceeding from said extreme transducer unit to the central transducer unit, and the highest index to the central transducer unit, the ratios between the conversion factors $A_x$ assigned to the transducer units satisfy the equation $A_1:A_2:A_3:A_4:A_5 = 1:2n:2n^2:n^3 - n:\frac{1}{4}(n^4-1) - 2n$.

By limiting the number of transducer units in the arrangement to a maximum of 9 and selecting the ratios between the conversion factors to accord with the specified equation, it is found that a very simple-to-realize arrangement with a frequency and direction independent conversion of sound waves can be obtained. It is to be noted that n is not necessarily an integer. Suitably, a small value will be selected for n because in that case all transducers will be subject to substantially equal loads or will provide substantially equal contributions to the signal in the transmission channel. Moreover, it has been assumed in the foregoing that the individual transducers supply an output signal which is independent of the direction and of the frequency. In practice, in the optimum case, the behaviour of the arrangement in respect of the frequency and direction independence will be identical to that of the individual transducer units.

In accordance with an embodiment of the invention, I dispense with those transducers units for which the conversion factor $A_x$ is zero. Since k is an integer and $2 \leqq k \leqq 4$, then $(2k+1)$ will be 5, 7 or 9.

By dispensing with the transducer units which are in fact not connected, it is possible to employ fewer transducers than the said 5, 7 or 9, while maintaining the frequency and direction-independent behaviour.

The value of n in the ratio may be characterized in that n is an integer, preferably equal to 1. By selecting an integer for n, very simple and convenient values are obtained for the ratios between the conversion factors because these values are frequently integers. If moreover n is selected to be 1, an arrangement is obtained for which the values of the ratios have magnitudes which do not differ excessively. This produces a very simple arrangement which may even be realized without active components (for example multipliers) and/or passive components (for example resistors).

A particular arrangement in accordance with the invention is characterized in that the two extreme transducer units are connected in series between two connection terminals and the other transducer units are connected in parallel with each other to said connection terminals.

Yet another embodiment of the invention is characterized in that the two extreme transducer units are connected in parallel with each other and the other transducer units together with the parallel-connected extreme transducer units are included in series between two connection terminals.

In both ways an arrangement with 5, 7 or 9 transducer units can be obtained, the ratios between the conversion factors being 1:2:2:−2:1; 1:2:2:0:−2:2:−1, and 1:2:2:0:−2:0:2:−2:1 respectively. In the case of an arrangement with five transducer units a transducer unit disposed between the central and one of the extreme transducer units should be connected with the opposite polarity to the others (so that it operates effectively in the opposite phase). In the case of an arrangement with seven transducer units one of the extreme transducer units and the third transducer unit, viewed from this end, should be connected with the opposite polarity to the others. Moreover, the distance between the two central transducer units will then be twice as great as the distance $d_1$ between the other transducer units because the central transducer unit is dispensed with. In the case of an arrangement with nine transducer units the central transducer unit and the second transducer unit, viewed from one end, should be connected with the opposite polarity to the others. Moreover, the distance between the central transducer unit and the transducer units adjacent said central transducer unit will then be twice as great as the distance $d_1$.

This yields arrangements in accordance with the invention with 5, 7 and 9 transducer units respectively, without the addition of a single passive element such as resistors, or an active element, such as for example amplifiers or attenuators.

In a further embodiment of the invention, which is adapted to transmit a stereophonic signal, each transducer unit is provided with a further amplitude control device. Those terminals of the further amplitude control devices which are remote from the transducer units are connected to a further electrical transmission channel and the conversion factors of each transducer unit for both of the channels are equal. The phase shifts in the transducer units for the left-hand channel, when proceeding from the one end to the other end of the arrangement, are equal to the phase shifts in the transducer units for the right-hand channel, when proceeding from the other end to the one end. It is to be noted that the principle of processing stereophonic signals is already known from the said Netherlands Patent No. 112,868, see FIG. 4. The difference is that the known arrangement for processing stereophonic signals does not utilize the ratios specified in the foregoing as the ratios between the conversion factors. Stereophonic sound reproduction or sound recording can be realized by means of an arrangement in accordance with the invention, the ratios between the conversion factors being in conformity with the simple values specified in the foregoing.

A combination of a plurality of arrangements in accordance with the invention is characterized in that it comprises $2l+1$ arrangements ($l$ being an integer and $2 \leqq l \leqq 4$). These arrangements are disposed at equal distances $d_2$ from each other in a direction perpendicular to their longitudinal direction or adjacent each other in their longitudinal direction, and each comprises a further amplitude control device for adjusting the conversion factor and the phase shift of each of the arrangements. The further amplitude control devices are connected to a common electrical transmission channel of the combination.

An advantage of placing a plurality of arrangements adjacent each other in a direction perpendicular to their longitudinal direction is that the frequency and direction independent behaviour in one plane may be combined with another desired behaviour in a second plane extending perpendicularly thereto. By selecting, for example, equal conversion factors for all arrangements, a very strong concentration of the radiation pattern is obtained in the second plane in the case of transducer units in the form of loudspeakers.

Another combination of a plurality of arrangements in accordance with the invention is characterized in that the distance $d_2$ between the central transducer units of two adjacent arrangements is equal to an integral multiple of the distance between two transducer units and smaller than the sum of the distances between the central transducer unit and the extreme transducer unit of each of said two adjacent arrangements.

By placing the arrangements in line in their longitudinal direction it is possible, by shifting the arrangements relative to each other, to make one or more transducer units of one arrangement coincide with an equal number of transducer units of another arrangement, so that a smaller number of transducer units will suffice. This results in a simpler circuit arrangement and, moreover, yields a direction and frequency-independent output signal.

Yet another combination in accordance with the invention is characterized in that arrangements which are situated symmetrically relative to the central arrangement have conversion factors of equal value, the phase shifts in the arrangements being equal, but the phase shift in one of every two of those arrangements which are situated at equal odd multiples of the distance ($d_2$) from the central arrangement differ by 180° from that in the other, that when an index x (x is an integer and $\leqq l+1$) is assigned to a plurality of the arrangements, the index 1 being asigned to one of the extreme arrangements, consecutive indices to consecutives adjacent arrangements, proceeding from said extreme arrangement to the central arrangement, and the highest index to the central arrangement, the ratios between the conversion factors of the arrangements $B_x$ satisfy the equations $B_1:B_2:B_3:B_4:B_5 = = 1:2m:2m^2:m^3-m:\frac{1}{4}(m^4-1)-2m^2$.

By further applying the principle of the invention to a plurality of arrangements in accordance with the invention which are situated adjacent each other at equal distances from each other in a direction perpendicular to their longitudinal direction, an output signal of the combination can be obtained which is substantially independent of the frequency and the direction in two mutually perpendicular planes. In the case of transducers constituted by loudspeakers, this results in a substantially frequency and direction-independent spherical radiator. The principle of the invention may also be applied to a plurality of arrangements which are disposed in line in their longitudinal direction.

In a further combination in accordance with the invention those arrangements for which the conversion factor $B_x$ is zero are dispensed with.

By dispersing with the arrangements, which are in fact not connected, a smaller number of arrangements than the said 5, 7 or 9 will suffice, while maintaining the frequency and direction-independent behaviour. A suitable choice for m is that of an integer, preferably 1. By selecting an integer for m very simple and convenient values are obtained for the ratios between the conversion factors of the arrangements because these values are then generally integers. If, moreover, m is selected to be 1, a combination is obtained for which the values of the ratios do not differ excessively in magnitude. This enables a very simple combination to be obtained, which may even be realized without any active components (for example amplifiers) and/or passive components (for example resistors).

One such combination in accordance with the invention is characterized in that the two extreme arrangements are connected in series between two connection terminals of the combination, and the other arrangements are connected in parallel with each other to said terminals.

Another such combination in accordance with the invention is characterized in that the extreme arrangements are connected in parallel with each other and the other arrangements, together with the parallel connected extreme arrangements, are included in series between two connection terminals of the combination.

In both ways a combination with 5, 7 or 9 arrangements can be obtained, the ratios between the conversion factors of the arrangements being 1:2:2:−2:1; 1:2:2:0:−2:2:−1, and 1:2:2:0:−2:0:2:−2:1 respectively. In the case of a combination with five arrangements the arrangement which is situated between the central arrangement and one of the extreme arrangements should be connected with the opposite polarity to the others. In the case of a combination with 7 arrangements one of the extreme arrangements and the third arrangement, viewed from this end, should be connected with the opposite polarity to the others. Moreover, the distance between the two central arrangements will be twice as great as the distance ($d_2$) between the other arrangements, if the central arrangement is dispensed with. In the case of a combination with 9 arrangements the central arrangement and the second arrangement, viewed from one end, should be connected with the opposite polarity to the others. Moreover, if the arrangements with zero conversion factors are omitted, then the distance between the central arrangement and the arrangement adjacent thereto is twice as great as the distance $d_2$. This yields combinations of arrangements in accordance with the invention without the addition of a single passive element, such as resistors, or an active element such as, for example, amplifiers or attenuators.

The invention will now be described in more detail with reference to the accompanying drawings, in which:

FIG. 1 shows an example of an arrangement in accordance with the invention comprising five transducers.

FIGS. 2*a* and 2*b* show circuit diagrams of the electrical connections of two embodiments of the arrangement with five transducers.

Figure 7A:
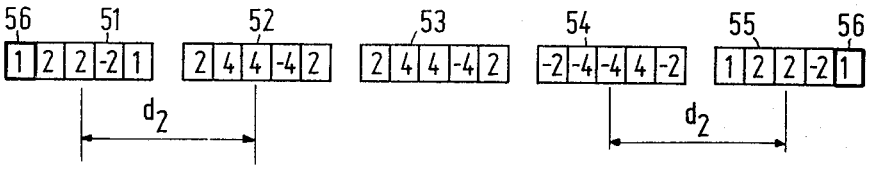
Figure 7B:
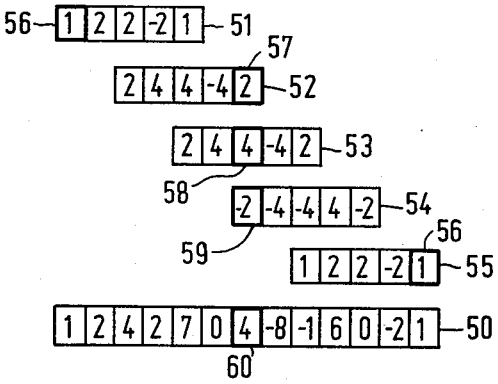

FIGS. 7*a* and 7*b* show two possible configurations of a combination of five arrangements disposed in line.

Figure 8:
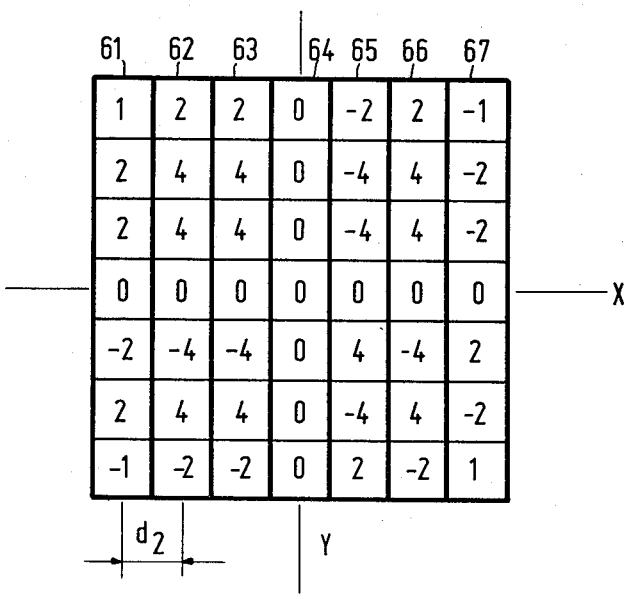

FIG. 8 shows an example of a combinaion of seven arrangements, the arrangements being disposed adjacent each other in a direction perpendicular to their longitudinal direction.

Figure 1:
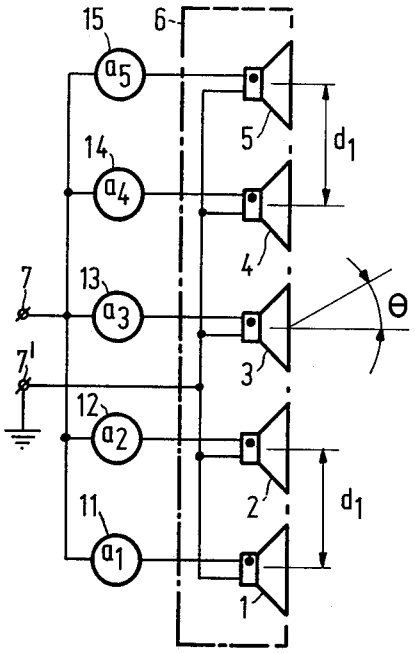

The arrangement of FIG. 1 is provided with five transducer units, which are constituted by transducers, for example, microphones or loudspeakers, and associated amplitude control devices 11–15. The transducers 1 to 5 are arranged in line and at equal distances $d_1$ from each other.

The five transducers may be accommodated in a cabinet 6, represented by a dash-dot line. The connection terminals of the transducers 1 to 5 are connected to the electrical transmission channel of the arrangement via associated amplitude control devices 11 to 15, which channel terminates at the connection terminals 7—7′ of the arrangement. The connection terminal of the transducer marked with a dot is the positive terminal. The amplitude control devices 11 to 15 may amplify or attenuate a signal and may have a phase-shifting or merely an inverting action. To this end the elements 11 to 15 may be constituted by amplifiers or attenuators or by passive components such as resistors and, as the case may be, together with the associated transducer, may be accommodated as a transducer unit in the cabinet 6. The values $a_1$ to $a_5$ represent the conversion factors of the transducers and the associated amplitude control devices 11 to 15. In the case of a loudspeaker the conversion factor is to be understood to mean: the conversion of the electric signal at the input of an amplitude control device into the acoustic signal at the output of the loudspeaker. In the case of microphones it means the conversion of an acoustic signal into an electrical signal at the output of an amplitude control device.

The conversion factors $a_{12}$ to $a_5$ of the transducer units are in a ratio of 1:2n:2n:−2n:1 to each other. This ensures that in the case where the transducers 1 to 5 are microphones, the magnitude of the electric signal at the terminals 7—7′ is substantially independent of the frequency or of the direction $\theta$ of the acoustic signal received by the arrangement. If the transducers 1 to 5 are loudspeakers, the arrangement being driven by an electric signal with a flat frequency characteristic via the terminals 7—7′, an acoustic signal is obtained which is substantially independent of the direction $\theta$ and of the frequency. It is then assumed that the individual transducers have a spherical directivity pattern. In practice a directivity pattern for the arrangement can be obtained which, in the optimum case, is identical to the directivity patterns of the individual transducers.

Figure 2A:
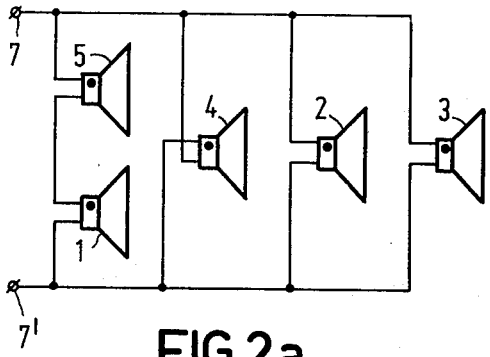
Figure 2B:
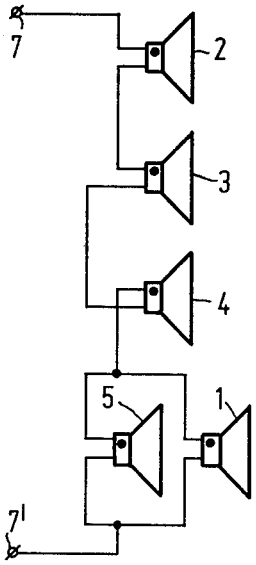

FIGS. 2*a* and 2*b* show the electrical connections of two embodiments of an arrangement with 5 transducers. The arrangements shown correspond to the arrangement of FIG. 1, the conversion factors $a_1$ to $a_5$ being in the ratios of 1:2:2:−2:1, i.e. n has the value 1. In FIG. 2*a* the transducers 1 and 5 are both connected in series between the connection terminals 7—7′ of the arrangement. The transducers 2, 3 and 4 are connected in parallel with the transducers 1 and 5. Transducers 2, 3 and 4 are also connected in parallel with each other. Moreover, the transducer 4 is connected with the opposite polarity. To this end the connection of the transducer 4 marked with a dot, unlike the other such connections, is connected to terminal 7′ of the arrangement. In FIG. 2*b* the transducers 1 and 5 are connected in parallel with each other. The other transducers 2, 3 and 4, together with the parallel-connected transducers 1 and 5, are connected in series between the connection terminals 7—7′ of the arrangement. The transducer 4 is connected with the opposite polarity. In both these ways an arrangement in accordance with the invention is obtained without a single addition of an amplifying or attenuating element 11 to 15, in the form of an amplifier or attenuator, or of a passitive component, such as a resistor. The circuit arrangement of FIG. 2*b* is to be preferred over that of FIG. 2*a* in some cases in view of the load presented by the arrangement to an amplifier to be connected to terminals 7—7′.

Figure 3:
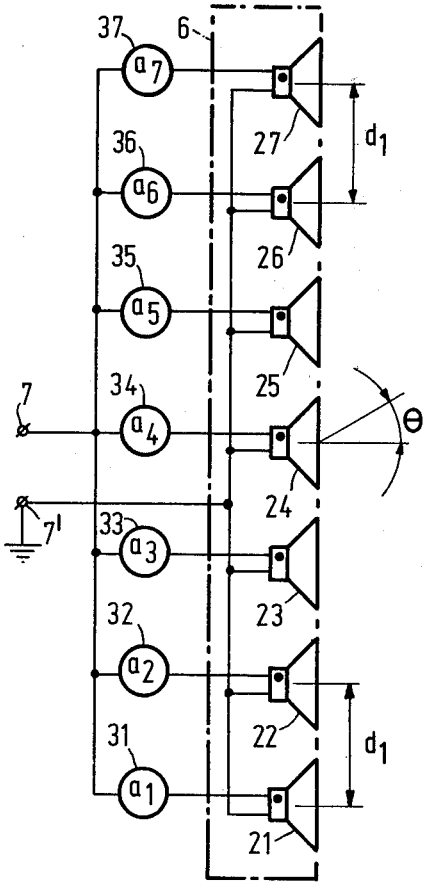
FIG. 3 shows another example of an arrangement in accordance with the invention, equipped with seven transducers.

FIG. 3 shows an example of an arrangement in accordance with the invention equipped with seven transducers 21 to 27. The transducers are situated at equal distances $d_1$ from each other. The seven transducers may be accommodated in a cabinet 6, represented by the dash-dot line. The connection terminals of the transducers 21 to 27 are connected to the electrical transmission channel of the arrangement via associated amplitude control devices 31 to 37, which channel terminates at terminals 7—7' of the arrangement.

The amplitude control devices 31 to 37 may amplify or attenuate a signal and may have a phase shifting or merely an inverting effect. Therefore, they may be constituted by amplifiers or attenuators or by passive components such as resistors, and, as the case may be together with the associated transducer, they may be accommodated in the cabinet 6 as a transducer unit. The amplitude control devices 31 to 37 are adjusted so that the conversion factors $a_1$ to $a_n$ of the transducer units are in a ratio of $1:2n:2n^2:n^3-n; -2n^2:2n:-1$. This yields an output signal which is substantially independent of the angle $\theta$ and of the frequency.

Figure 4A:
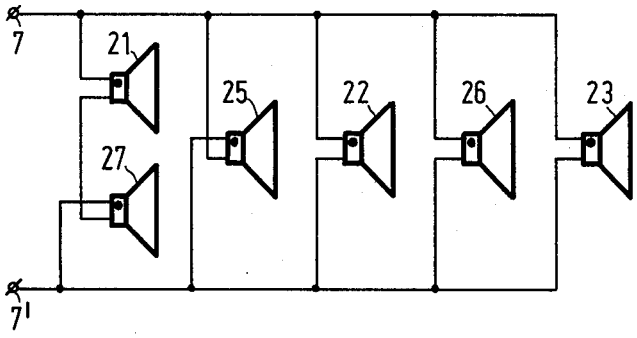
FIGS. 4*a* and 4*b* show the electrical connections of two possible embodiments of the arrangement with seven transducers, of which one transducer can be omitted.
Figure 4B:
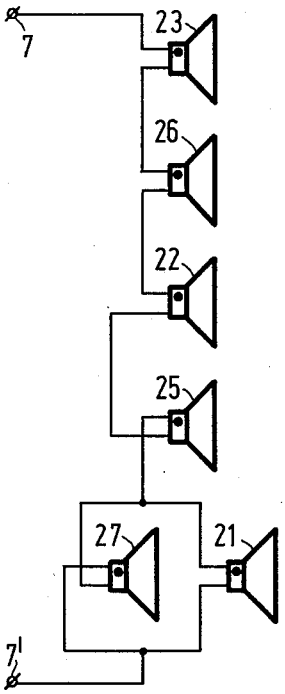

FIGS. 4*a* and 4*b* show the electrical connections of two embodiments of an arrangement with seven transducers of which one transducer can be omitted. These embodiments are based on the arrangement of FIG. 3, the conversion factors being in a ratio of $1:2:2:0:-2:2:-1$ to each other, i.e. n has the value 1. The central transducer unit has a conversion factor zero and may therefore be dispensed with so that six transducers remain in the arrangement, the distance between the transducers 23 and 25 being $2d_1$. In FIG. 4*a* transducers 22, 23 and 26 are connected in parallel with each other between the connection terminals 7—7' with like polarities. The transducer 25 is connected with the opposite polarity in parallel with the other three parallel-connected transducers. The connection of transducer 25 marked with the dot, unlike the corresponding connections of the transducers 22, 23 and 26, is therefore connected to the connection terminal 7' of the arrangement. The extreme transducers 21 and 27 are connected in series, the transducer 27 being connected with the opposite polarity. For this purpose the connection of the transducer 27 marked with the dot is connected to the connection terminal 7'. In FIG. 4*b* the transducers 21 ad 27 are connected in parallel with each other. The other transducers 22, 23, 25 and 26, together with the parallel-connected transducers 21 and 27, are connected in series between the connection terminals 7—7' of the arrangement. The transducers 27 and 25 are connected with the opposite polarity to the others. In both embodiments this yields an arrangement in accordance with the invention without any addition of an amplifying or attenuating element, or of passive components such as resistors.

In some cases the arrangement of FIG. 4*b* is to be preferred over that of FIG. 4*a* in view of the load presented by the arrangement to the amplifier to be connected to the connection terminals 7—7'.

In a manner similar to that described in the foregoing, an arrangement in accordance with FIGS. 1 or 3 but provided with 9 transducers can be obtained. The conversion factors of the transducer units should then be in the ratio of $1:2n:2n^2:n^3-n:\frac{1}{4}(n^4-1)-2n^2:-(n^3-n):2n^2:-2n:1$. A particular embodiment thereof is an arrangement in which the value n is 1. This results in ratios of $1:2:2:0:-2:0:2:-2:1$. Similarly to the arrangement of FIGS. 2 and 4, this arrangement can be very simple, i.e. without additional active or passive components. The conversion factors of the transducer units adjacent the central transducer unit are zero so that these transducer units may be dispensed with. The central transducer and the transducer adjacent one of the extreme transducers are connected with the opposite polarity to the others.

Figure 5:
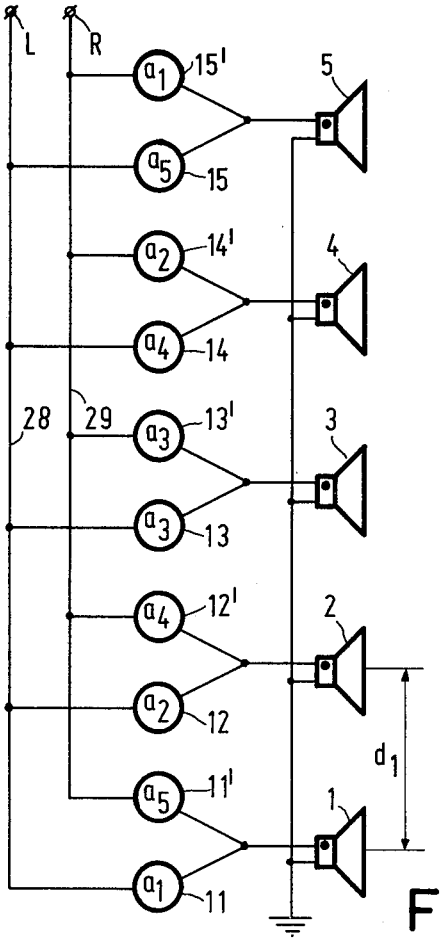
FIG. 5 shows an example of an arrangement for processing stereophonic signals.

FIG. 5 shows an arrangement by means of which stereophonic signals can be processed. By way of example an arrangement is shown comprising five transducers 1 to 5 in the form of loudspeakers. Each transducer is connected to two transmission channels 28 and 29 via two amplitude control devices, which channels terminate at the input terminals L and R. The left-hand and right-hand signal components of the stereophonic signal are applied to the arrangement via input terminals L and R. The two signal components are applied to the respective transducers 1 to 5 via the amplitude control devices 11 and 11', 12 and 12', 13 and 13', 14 and 14', and 15 and 15' respectively. The ratios between the conversion factors $a_1$ to $a_5$ of the transducer units, obtained by the settings of the respective amplitude control devices 11 to 15, progressing from one end (for example transducer 1) to the other end (transducer 5) of the arrangement, are equal to the ratios between the conversion factors obtained by the settings of the respective amplitude control devices 11' to 15', progressing from the other end (transducer 5) of the arrangement to the one end, and correspond to the ratios as indicated for FIG. 1. An arrangement as in FIG. 5, but including 7 or 9 transducers in the form of loudspeakers or microphones with the respective ratios specified with reference to the preceding Figures, can be obtained in a similar way.

Figure 6:
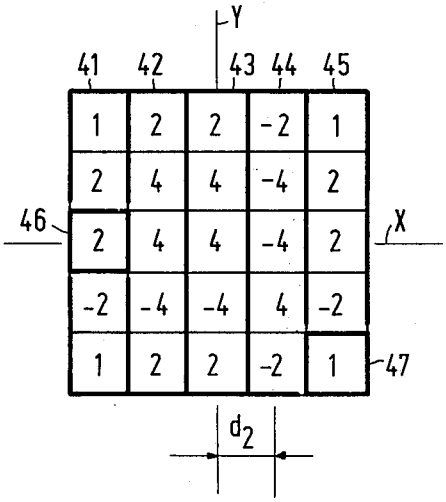
FIG. 6 shows an example of an embodiment of a combination of five arrangements, which are situated adjacent each other in a direction perpendicular to their longitudinal direction.

FIG. 6 is a schematic front view of an example of a combination of five arrangements in accordance with the invention. Each arrangement may comprise 5, 7 or 9 transducers as described hereinbefore. FIG. 6 shows five arrangements 41 to 45, each comprising five transducers. Each transducer is schematically represented by a square, such as 46 or 47. The arrangements are disposed adjacent each other at equal distances from each other in a direction perpendicular to their longitudinal direction.

The ratios between the conversion factors of the transducer units are $1:2n:2n^2:-2n:1$ for all arrangements, n having the same value for all arrangements. The five arrangements are each provided with a further amplitude control device, not shown, these being all connected to one electrical transmission channel of the combination. By means of these amplitude control devices the conversion factors of the arrangements can be selected so that a desired directivity pattern can be obtained in a plane perpendicular to the plane of the drawing and intersecting the latter plane along the line x. Thus, in order to obtain a high concentration in the former plane by means of this combination, these conversion factors should be chosen equal to each other. In the case of a combination comprising loudspeakers, this means that all transducers disposed on a horizontal line receive the same signal amplitude.

However, it is alternatively possible that the ratios between the conversion factors of the arrangements progressing from one end of the combination to the other end are $1:2m:2m^2:-2m:1$. This step ensures that the combination also has, in a plane perpendicular to the plane of the drawing and intersecting this plane along the line x, a behaviour which is independent of frequency and direction. In the case of a combination comprising loudspeakers this results in a three-dimensional spherical radiator.

A possible embodiment of such a combination is shown in FIG. 6, the ratios between the conversion factors of the transducer units in each arrangement, and between the conversion factors of the arrangements being $1:2:2:-2:1$, i.e. n and m have the value 1, so that both horizontally and vertically the ratios between the conversion factors are the same. The ratios of the signal amplitudes to be applied to the transducers, if the combination comprises loudspeakers, to the smallest signal amplitude applied to transducer 47, are represented by the numbers in the respective squares. In view of the load presented by the combination to the amplifier connected to the connection terminals of the combination, it is preferred to arrange the transducers in the arrangements as is for example shown in FIG. 2*a* and to connect the arrangements in the combination in a manner as is represented in FIG. 2*b* for transducers, or the other way around.

FIG. 7*a* is a front view of another example of five arrangements, this time disposed in a line. Although each arrangement may comprise 5, 7 or 9 transducers, FIG. 7*a* shows arrangements 51 to 55 with 5 transducers which are disposed adjacent each other with their centres at equal distances $d_2$ from each other. Each transducer is schematically represented as a square. The ratios between the conversion factors of the transducer units in each arrangement are $1:2n:2n^2:-2n:1$, n having the same value for all arrangements. The five arrangements are each provided with an individual amplitude control device, which devices are all connected to one electrical transmission channel of the combination. The amplitude control devices are adjusted so that the ratios between the conversion factors of the arrangements, on going from one end of the combination towards the other end, are $1:2m:2m^2:-2m:1$. A suitable embodiment of this is given in FIG. 7*a*, the ratios between the conversion factors of the transducer units of each arrangement as well as between those of the arrangements being $1:2:2:-2:1$, i.e. n and m have the value 1. If the transducers are loudspeakers, the numbers in the squares represent the signal amplitude with which the relevant transducer is driven. The numbers have been referred to the smallest signal amplitude applied to the transducer 56.

FIG. 7*b* shows a combination similar to that of FIG. 7*a*. The distance $d_2$ between two adjacent arrangements, however, has been selected smaller than the sum of the distances between the central transducer and the extreme transducer of two adjacent arrangements. By interlacing the arrangements in such a way that one or more transducers of two adjacent arrangements coincide, it is possible to use a substantially smaller number of transducers than five times the number of transducers per arrangement. This is schematically represented in FIG. 7*b*. For the sake of clarity the interlaced arrangements 51 to 55 of FIG. 7*a* are therefore shown slightly shifted in a direction perpendicular to their longitudinal direction. The combination 50 is now obtained by adding the conversion factors of corresponding transducers of different arrangements, such as 57, 58 and 59 of the arrangements 52, 53 and 54, yielding the value of the amplitude of the transducer 60 of the combination. It is evident that for two transducers the conversion factor will become zero, so that these transducers may be dispensed with, which results in only 11 transducers in the combination.

For the preferred embodiment of the arrangement of FIG. 7*a* in which n and m are 1, the transducers in each arrangement should preferably be connected as is for example shown in FIG. 2*a* and the arrangements in the combination should be connected as is shown in FIG. 2*b*, or the other way around. This is in view of the load which is presented by the combination to an amplifier connected to the connection terminals of the combination.

FIG. 8 is a schematic front fiew of an example of a combination of seven arrangements in accordance with the invention. Although each arrangement may comprise 5, 7 or 9 transducers, FIG. 8 shows arrangements 61 through 67 each comprising 7 transducers, which arrangements are disposed adjacent each other at equal distances $d_2$ from each other in a direction perpendicular to their longitudinal direction.

The ratios between the conversion factors of the transducer units are $1:2n:2n^2:n^3-n:-2n^2:2n:-1$ for all arrangements, n having the same value for all arrangements. The seven arrangements are each provided with a further amplitude control device, not shown, which devices are all connected to an electrical transmission channel of the combination. These amplitude control devices are adjusted in such a way that the conversion factors of the arrangements can assume values such that a desired directivity pattern can be obtained in a plane perpendicular to the plane of the drawing and intersecting the latter plane along the line x. Thus, in order to obtain a strong concentration in the former plane by means of this combination, these conversion factors should be chosen equal to each other.

In the case of a combination comprising loudspeakers, this means that all transducers disposed on a horizontal line receive the same signal amplitude.

However, it is alternatively possible that the ratios between the conversion factors of the arrangements are $1:2m:2m^2:m^3-m:-2m^2:2m:-1$. This step ensures that the combination also exhibits, in the plane perpendicular to the plane of the drawing and intersecting this plane along the line x, a behaviour which is frequency and direction-independent. In the case of a combination comprising loudspeakers; this results in a three-dimensional spherical radiator.

A preferred embodiment of such a combination is shown in FIG. 8, the ratios between the conversion factors of the transducers in each arrangement, and between the conversion factors of the arrangements being $1:2:2:0:-2:2:-1$, i.e. n and m have the value 1, so that both horizontally and vertically the same amplitude ratios are obtained. The ratios of the signal amplitudes applied to the transducers, to the smallest signal amplitude to be applied, are represented by the numbers in the squares.

In this preferred embodiment the loudspeakers in the central column and row may be dispensed with because the conversion factors and thus the signal amplitudes to be applied are zero for these transducers. This yields a simpler construction and an arrangement with fewer transducers. The distance between the two arrangements 63 and 65 is then twice as great as the distance $d_2$ between the other adjacent arrangements.

For the same reasons as in the foregoing for the combination with five arrangements, the transducers in the arrangements should preferably be connected as is for example shown in FIG. 4*a* and the arrangements in the combination should be connected as is represented in FIG. 4*b* for transducers, or the other way around.

In an analogous manner to the combination of FIG. 7 a combination with seven arrangements comprising 5, 7 or 9 transducers is possible, the arrangements being disposed in line adjacent each other at equal distances from each other.

The seven arrangements each comprise an amplitude control device, which devices are all connected to an electrical transmission channel, the ratios between the conversion factors of the arrangements, on going from the one end of the combination to the other end, being $1:2m:2m^2:m^3-m:-2m^2:2m:-1$.

A combination of nine arrangements with 5, 7 or 9 transducers may be realized in a similar way as in FIG. 6 or 8. The ratios between the conversion factors of the transducer units in each arrangement will then be the same for all arrangements. The arrangements then each comprise an amplitude control device, which devices are all connected to a common electrical transmission channel of the combination. The amplitude control devices may be adjusted so that the ratios between the conversion factors of the arrangements are $1:2m:2m^2:m^3-m:\frac{1}{4}(m^4-1)-2m^2::-(m^3-m):2m^2:-2m:1$. In this case a combination with a spherical directivity pattern is obtained. In a preferred embodiment the ratios between the conversion factors of the arrangements are $1:2:2:0:-2:0:2:-2:1$, so that a very simple circuitry for the arrangement is obtained. The two arrangements adjacent the central arrangement have a conversion factor equal to zero and may be dispensed with. Moreover, the central arrangement and one of the arrangements adjacent the extreme arrangements are connected to the connection terminals of the combination with the opposite polarity to the others.

The conversion factors of the arrangements may also be selected equal to each other. In that case a strong concentration of the directivity pattern is obtained in a plane perpendicular to the longitudinal direction of the arrangements. In a manner similar to that shown in FIG. 7, a combination of nine arrangements with 5, 7 or 9 transducers may be realized, which are disposed in line in their longitudinal direction.

It is to be noted that the invention is not limited to the arrangements and combinations as described in the foregoing. The invention is also applicable to arrangements and combinations in which the transducers are not constituted by separate transducers but form part of a single transducer. An example of this for loudspeakers is a single electret transducer whose sound-radiating diaphragm is divided into diaphragm sections, each with a separate signal drive, which constitute the individual transducers for the arrangements and/or combinations.

The sequence in which the specified ratios of the conversion factors of the transducers in an arrangement or of the arrangements in combination occur is not limited to the sequence states. The sequence may equally well be reversed.

Finally, it is to be noted that if the frequency range of the sound signals to be reproduced or the sound waves to be received is divided into two or more separate input or output signals, each signal representing one frequency range, the arrangements or combinations should be duplicated one or more times, each arrangement or combination covering one frequency range, corresponding transducers or arrangements for the different frequency ranges having equal conversion factors.

What is claimed is:

1. An electro-acoustic transducer comprising $(2K+1)$ transducer units with substantially identical directivity patterns (k being an integer wherein $2 \leqq k \leqq 4$), said transducer units being situated in line at equal distances ($d_1$) from each other and being connected to a common electrical transmission channel, each transducer unit including a transducer and an amplitude control device for adjusting the conversion factor of the associated transducer unit, transducer units which are disposed symmetrically relative to a central transducer unit having conversion factors of equal value, the phase shifts in the transducer units being equal, but the phase shift in one of every two of those transducer units which are situated at equal odd multiples of the distance ($d_1$) from the central transducer unit differing by 180° from one another, the conversion factors being selected to produce a substantially frequency and direction-independent conversion of the sound waves when an index x (x being an interger in the range of 1 to $k+1$) is assigned to a plurality of the transducer units, the index 1 being assigned to one of the extreme transducer units, consecutive indices to consecutive adjacent transducer units, proceeding from said extreme transducer unit to the central transducer unit with the highest index assigned to the central transducer unit, and wherein the ratios between the conversion factors $A_x$ assigned to the transducer units satisfy the equation $A_1:A_2:A_3:A_4:A_5=1:2n:2n^2:n^3-n:\frac{1}{4}(n^4-1)-2n^2$, wherein n has a value not equal to zero.

2. An arrangement as claimed in claim 1 wherein those transducer units having a conversion factor $A_x$ of zero are not included in the arrangement.

3. An arrangement as claimed in claim 1 wherein n is an integer.

4. An arrangement as claimed in claims 2 or, 3 including means connecting the two extreme transducer units in series between two connection terminals and the other transducer units in parallel with each other to said connection terminals.

5. An arrangement as claimed in claims 2 or, 3 including means connecting the two extreme transducer units in parallel with each other, and means connecting the other transducer units in series with each other and with the parallel-connected extreme transducer units between two connection terminals.

6. An arrangement as claimed in claims 1, 2, or 3 for the transmissions of a stereophonic signal, each transducer unit including a further amplitude control device with those terminals of the further amplitude control devices which are remote from the transducer units being connected to a further electrical transmission channel, the conversion factors of each transducer unit for the left hand and right hand channels being equal, and wherein the phase shifts in the transducer units for the left-hand channel, when proceeding from the one end to the other end of the arrangement, are equal to the phase shifts in the transducer units for the right-hand channel, when proceeding from the other end to the one end.

7. A combination of a plurality of arrangements as claimed in claims 1, 2, or 3 wherein the combination comprises $2l+1$ arrangements (l being an integer where $2<l<4$), said arrangements being disposed at equal distances $d_2$ from each other in a direction perpendicular to their longitudinal direction or adjacent each other in the longitudinal direction, and each comprise a further amplitude control device for adjusting the conversion factor and the phase shift of each of the arrangements, said further amplitude control devices being connected to a common electrical transmission channel of the combination.

8. A combination as claimed in claim 7 with the arrangements being disposed adjacent each other in their longitudinal direction, characterized in that the distance $d_2$ between the central transducer units of two adjacent arrangements is equal to an integral multiple of the distance between two transducer units and smaller than the sum of the distances between the central transducer unit and the extreme transducer unit of each of said two adjacent arrangements.

9. A combination as claimed in claim 7, characterized in that arrangements which are situated symmetrically relative to the central arrangement have conversion factors of equal value, the phase shifts in the arrangements being equal, but the phase shift in one of every two of those arrangements which are situated at equal odd multiples of the distance ($d_2$) from the central arrangement differing by 180° from that in the other, that when an index x (x being an integer in the range of l to l+1) is assigned to a plurality of the arrangements, the index 1 being assigned to one of the extreme arrangements, consecutive indives to consecutive adjacent arrangements, proceeding from said extreme arrangement to the central arrangement with the highest index assigned to the central arrangement, the ratios between the conversion factors of the arrangements $B_x$ satisfy the equation $B_1:B_2:B_3:B_4:B_5=1:2m:2m^2:m^3-m:\frac{1}{4}(m^4-1)-2m^2$, where m has a value not equal to zero.

10. A combination as claimed in claim 9 wherein those arrangements having a conversion factor $B_x$ of zero are not a part of the combination.

11. A combination as claimed in claim 9, characterized in that m is an integer.

12. A combination as claimed in claim 11, characterized in that the two extreme arrangements are connected in series between two connection terminals of the combination and the other arrangements, are connected in parallel with each other to said connection terminals.

13. A combination as claimed in claim 11, characterized in that the extreme arrangements are connected in parallel with each other, and the other arrangements are connected in series with each other and with the parallel-connected extreme arrangements between two connection terminals of the combination.

14. A combination as claimed in claim 10 further comprising means connecting the two extreme arrangements in series between two connection terminals of the combination, and means connecting the other arrangements in parallel with each other to said connection terminals.

15. A combination as claimed in claim 10 further comprising means connecting the extreme arrangements in parallel with each other, and means connecting the other arrangements in series with each other and with the parallel-connected extreme arrangements between two connection terminals of the combination.

16. An arrangement as claimed in claim 2 wherein n is an integer.

17. A combination as claimed in claim 8 characterized in that arrangements which are situated symmetrically relative to the central arrangement have conversion factors of equal value, the phase shifts in the arrangements being equal, but the phase shift in one of every two of those arrangements which are situated at equal odd multiples of the distance ($d_2$) from the central arrangement differing by 180° from that in the other, that when an index x (x being an integer in the range of l to l+1) is assigned to a plurality of the arrangements, the index 1 being assigned to one of the extreme arrangements, consecutive indices to consecutive adjacent arrangements, proceeding from said extreme arrangement to the central arrangement with the highest index assigned to the central arrangement, the ratios between the conversion factors of the arrangements $B_x$ satisfy the equation $B_1:B_2:B_3:B_4:B_5=1:2m:2m^2:m^3-m:\frac{1}{4}(m^4-1)-2m^2$, where m has a value not equal to zero.

18. A combination as claimed in claim 17 wherein those arrangements having a conversion factor $B_x$ of zero are not a part of the combination.

19. A combination as claimed in claim 18 characterized in that m is an integer, preferably 1.

20. An arrangement as claimed in claims 1 or 2 wherein n is 1.

* * * * *

UNITED STATES PATENT AND TRADEMARK OFFICE

CERTIFICATE OF CORRECTION

PATENT NO. : 4,399,328

DATED : August 16, 1983

INVENTOR(S) : NICO V. FRANSSEN, DECEASED

It is certified that error appears in the above—identified patent and that said Letters Patent is hereby corrected as shown below:

In the Specification:

Column 1, line 6, after "an" insert --electro-acoustic transducer--

Column 1, line 63, after "The" (first occurence) insert --electro-acoustic transducer--

Column 3, line 41, change "and" to --where--

Column 4, line 18, after "other" delete "," (comma) and insert --. This embodiment is further characterized in--

Column 4, line 18, change "is an" to --being-- and change "and" to --that is--

Column 4, line 23, after "and" insert --with--

Column 4, line 24, before "to" insert --assigned--

Claim 1, line 1, after "transducer" insert --arrangement--
line 22, after "indices" insert --being assigned--
line 23, after "units" delete "," (comma)
line 24, after "unit" (second occurence) insert --and--

Claim 4, line 1, delete "2 or, 3" insert --2, 3 or 16--

Claim 5, line 1, delete "2 or, 3" insert --2, 3 or 16--

UNITED STATES PATENT AND TRADEMARK OFFICE

CERTIFICATE OF CORRECTION

PATENT NO. : 4,399,328

DATED : August 16, 1983

INVENTOR(S) : Nico V. Franssen, Deceased

It is certified that error appears in the above-identified patent and that said Letters Patent is hereby corrected as shown below:

Claim 6, line 1, delete "1, 2, or 3" insert --1, 2, 3 or 16--
line 2, change "transmissions" to --transmission--

Claim 7, line 4, change "2∠1∠4)" to --2≦1≦4)--

Claim 9, line 12, change "indives" to --indices--
line 14, after "arrangement" insert --and--

Claim 12, line 4, after "arrangements" delete "," (comma)

Claim 17, line 14, after "arrangement" insert --and--

Insert new Claim 21 as follows:

--Claim 21. A combination as claimed in Claim 9, wherein m is the integer one.--

Signed and Sealed this

*Sixteenth* Day of *October 1984*

[SEAL]

*Attest:*

GERALD J. MOSSINGHOFF

*Attesting Officer*

*Commissioner of Patents and Trademarks*